United States Patent [19]

Martin

[11] 4,316,417

[45] Feb. 23, 1982

[54] WELDED SIDE FRAME COLUMN WEAR PLATE

[75] Inventor: Albert E. Martin, Lancaster, N.Y.

[73] Assignee: Dresser Industries, Inc., Dallas, Tex.

[21] Appl. No.: 648,994

[22] Filed: Jan. 14, 1976

[51] Int. Cl.[3] ..... B61F 5/12; B61F 5/24; B61F 5/50

[52] U.S. Cl. ..... 105/197 DB; 105/197 D; 105/207; 105/225

[58] Field of Search ..... 105/197 D, 197 DB, 207, 105/225; 228/135, 140, 178

[56] References Cited

U.S. PATENT DOCUMENTS

| | | | |
|---|---|---|---|
| 2,365,199 | 12/1944 | Light | 105/197 D |
| 2,378,229 | 6/1945 | Light | 105/197 D |
| 3,548,754 | 12/1970 | Williams | 105/197 D |
| 3,834,320 | 9/1974 | Tack | 105/197 DB X |
| 3,851,595 | 12/1974 | Clasen | 105/197 DB |
| 3,880,089 | 4/1975 | Wallace | 105/207 X |

*Primary Examiner*—Joseph F. Peters, Jr.
*Assistant Examiner*—Howard Beltran
*Attorney, Agent, or Firm*—Raymond T. Majesko

[57] ABSTRACT

A railway car truck having side frames with an opening for receiving the ends of a bolster, and spaced columns with removable wear resistant wear plates, secured thereto and retained by L-shaped retainers at the corners.

5 Claims, 5 Drawing Figures

WELDED SIDE FRAME COLUMN WEAR PLATE

Railway car trucks generally include two windowed side frames and a truck bolster having ends disposed in the windows for permissible vertical and horizontal movement therein. The bolster extends across the truck and is supported by load carrying springs between the side frames and the bolster ends.

Pockets are usually provided in the side frames or the bolsters to receive wedge or friction shoes. Each shoe has a vertical friction surface which engages a friction surface on the vertical column of the side frame and an inclined wedging friction surface engaging an inclined friction surface on the bolster. There may be one or two such wedge and pocket assemblies at each end of the bolster. It has been a current practice to provide a wear resistant wear plate on the vertical columns of the side frame coming into engagement with the friction wedge. Many known techniques were utilized to secure the wear plate to the column, i.e. various combinations of bolting and welding and the use of lugs. Many of these wear plates secured by such techniques have not met with functional success.

An object of the present invention is to provide an improved side frame column wear plate arrangement wherein there is increased retention of the wear plate in both the horizontal and vertical directions.

Other objects and advantages of the invention will be apparent from the following detailed description and drawings in which.

In accordance with the present invention, there is provided a railway car truck having side frames with an opening for receiving the ends of a bolster. The opening is defined by an upper compression member and a lower tension member and laterally spaced vertical columns adapted to receive a removable wear plate. A vertical wear plate is disposed on at least one of the columns. The wear plate contains a wear surface for frictional contact. It also has top and bottom surfaces and side surfaces which are connected at corners. L-shaped retainers are disposed at the corners for restraining vertical and horizontal movement of the wear plate. A weldment is disposed at least between the L-shaped retainers and portions of the adjacent edge surfaces of the wear plate with the wear plate in intimate contact with the column.

Figure 1:
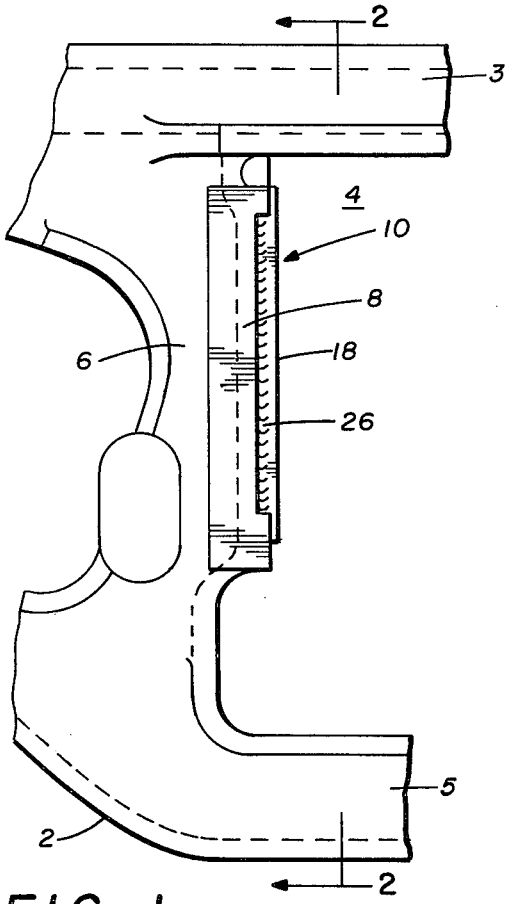
FIG. 1 is a side elevation view of a part of a railway car truck side frame showing an embodiment of the present invention.
Figure 2:
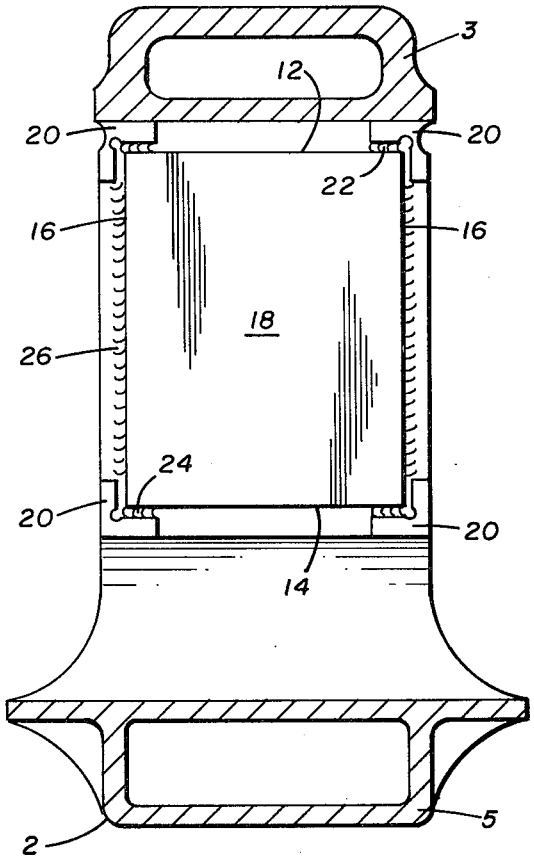
FIG. 2 is a front elevation view taken along line 2—2 of FIG. 1.

Referring to FIGS. 1 and 2, there is shown a portion 2 of a railway car truck side frame having a window opening 4 to receive the ends of a bolster (not shown). The opening is enclosed by an upper compression number 3 and a lower tension member 5 and on each side by columns 6, only one of said columns being illustrated.

The columns 6 contain a vertical surface 8 for receiving a heat treated wear plate 10 which is generally flat surfaced and rectangular in configuration. The wear plate contains top and bottom surfaces 12 and 14 respectively, side surfaces 16 and a wear surface 18.

Disposed at each corner of the wear plate 10 are angular L-shaped retainers 20 for restraining vertical and horizontal movement of the wear plate. The retainers project outwardly from the column 6 and are preferably cast integral therewith. A weldment 22 extends between the top surface 12 of the wear plate and the retainer, and also a weldment 24 extends between the bottom surface 14 of the wear plate and the retainer. There also may be a weldment between the side surfaces 16 of the plate and the retainer 20, if desired. These weldments are in contact with the column surface for securing the wear plate.

In addition, preferably, there is a continuous vertical weldment extending between the upper and lower retainers between the side surfaces 16 of the wear plate and the column for additionally securing the plate. These continuous side surface welds are not as susceptible to fatigue failures as are spot welds because of the reduced number of starts and stops which leave crater cracks.

Figure 3:
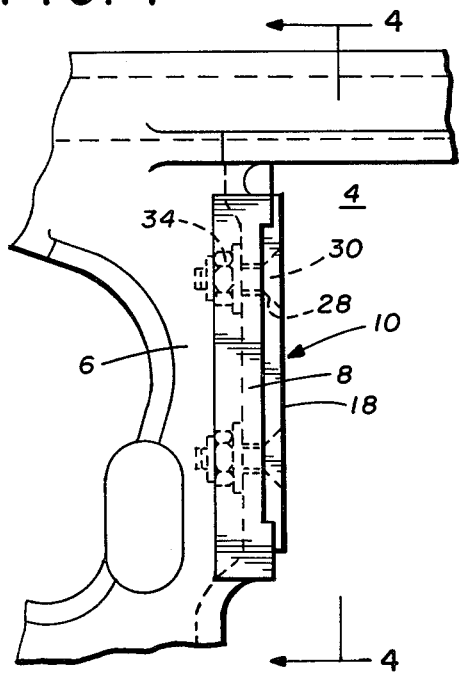
FIG. 3 is a side elevation view of a part of a railway car truck side frame showing another embodiment of the present invention.
Figure 5:
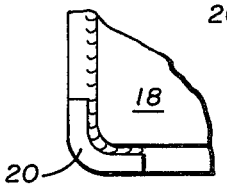
FIG. 5 is a portion of a front elevation view showing a modification of the construction of FIGS. 1 to 4.
Figure 4:
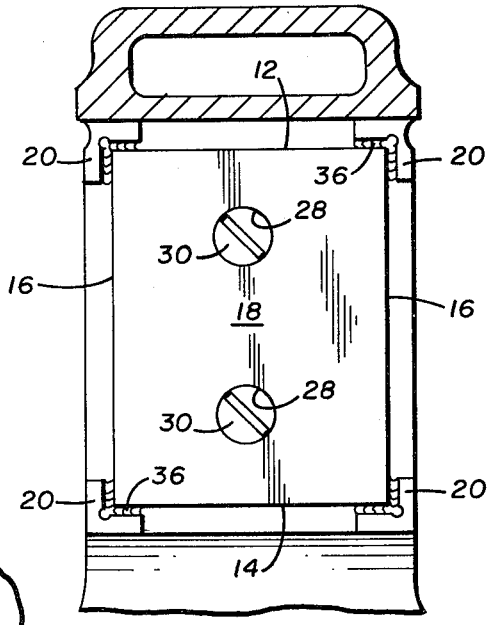
FIG. 4 is a front elevation view taken along line 4—4 of FIG. 3.

Referring now to FIGS. 3 and 4 wherein like numerals designate like parts, there is shown a wear plate having two countersunk bolt receiving apertures 28 spaced vertically along approximately the vertical centerline of the plate. Threaded bolts 30 having conical heads 32 engage the countersunk surfaces 28. The bolts are engaged by threaded nuts 34 to hold the plate tightly against the column surfaces 8. L-shaped retainers 20 are disposed at the corner of each plate. With countersunk bolts, small movements of the plate cause wedging action under the conical head in alternating directions thereby causing fatigue failures of the heads. This is predominantly in the up and down direction. Accordingly, preferably, weldments 36 are disposed between the retainers 20 and top and bottom surfaces 12 and 14 of the plate, and also between the side surfaces 16 of the plate and the retainers.

From the above description, it will be apparent that there has been provided an improved retention means for a side frame column wear plate. It should be understood that the described and disclosed embodiments are merely exemplary of the invention and that all modifications are intended to be included that do not depart from the spirit of the invention and the scope of the appended claims.

The embodiments of the invention in which an exclusive property or privilege is claimed are defined as follows:

1. A railway car truck having side frames with an opening for receiving ends of a bolster, the opening having laterally spaced vertical columns adapted to receive a removable wear plate, a vertical wear plate disposed on at least one of said columns below an upper compression member and above a lower tension member, the plate being less than the vertical extent of the column and, having a wear surface and top and bottom edge surfaces and side edge surfaces connected at corners, there being L-shaped retainers disposed adjacent the corners for restraining vertical and horizontal movement of the wear plate and a weldment at least between the L-shaped retainers and portions of the adjacent edge surfaces of the wear plate with the wear plate in intimate contact with the column for securing the wear plate.

2. The truck of claim 1, wherein the wear plate contains in addition, at least two countersunk bolt receiving apertures having bolts therein for additionally securing the wear plate.

3. The truck of claim 1, in which the L-shaped retainers project outwardly from the column a distance short of the wear surface of the wear plate.

4. The truck of claim 1, wherein the wear plate contains in addition, a continuous vertical weldment between the side edge surfaces thereof and the column extending at least between the L-shaped retainers for additionally securing the wear plate.

5. The truck of claim 4, in which the weldments extend outwardly a distance short of the wear surface of the wear plate.

* * * * *